US011020305B2

(12) United States Patent
Lunsford

(10) Patent No.: US 11,020,305 B2
(45) Date of Patent: Jun. 1, 2021

(54) CANTING MECHANISM FOR AMBULATORY SUPPORT APPARATUS AND METHOD

(71) Applicant: David Lunsford, Minneapolis, MN (US)

(72) Inventor: David Lunsford, Minneapolis, MN (US)

(73) Assignee: David Lunsford, San Antonio, TX (US)

( * ) Notice: Subject to any disclaimer, the term of this patent is extended or adjusted under 35 U.S.C. 154(b) by 708 days.

(21) Appl. No.: 15/628,935

(22) Filed: Jun. 21, 2017

(65) Prior Publication Data

US 2018/0369051 A1 Dec. 27, 2018

(51) Int. Cl.

| | |
|---|---|
| ***A61H 1/00*** | (2006.01) |
| ***A61H 23/02*** | (2006.01) |
| ***A61H 39/04*** | (2006.01) |

(52) U.S. Cl.

CPC ..... *A61H 1/006* (2013.01); *A61H 23/02* (2013.01); *A61H 39/04* (2013.01);

(Continued)

(58) Field of Classification Search

CPC ..... A61H 1/006; A61H 39/04; A61H 23/02; A61H 2201/1623; A61H 2201/1628; A61H 2201/1645; A61H 2201/169; A61H 2205/08; A61H 2201/165; A61H 2205/081; A61H 2205/108; A61H 2205/088; A61H 11/00; A61H 2011/005; A61H 39/00; A61H 23/00; A61H 23/006; A61H 23/0245; A61H 23/0254; A61H 23/0263

See application file for complete search history.

(56) References Cited

U.S. PATENT DOCUMENTS 4,182,338 A * 1/1980 Stanulis ..... A61B 17/1322 606/203
4,702,235 A * 10/1987 Hong ..... A61F 7/007 602/13

(Continued)

FOREIGN PATENT DOCUMENTS

WO WO-03039659 A1 * 5/2003 ..... A61N 1/32
WO WO-2016085748 A1 * 6/2016 ..... A61H 15/00

OTHER PUBLICATIONS

"Paracord Ranger Beads", Wild Wolf, Feb. 6, 2017.*

*Primary Examiner* — Tu A Vo

(74) *Attorney, Agent, or Firm* — David Lunsford

(57) ABSTRACT

An apparatus for placing pressure on a plurality of trigger points includes a support, a first pressure element, and a second pressure element. The first pressure element is carried by the support. The second pressure element is carried by the support. The first pressure element is moveable with respect to the support, and the second pressure element is moveable with respect to the support. The first pressure element and the second pressure element are also moveable with respect to each other. The support has a length so that the support can be attached around a lower portion of the trunk of a human body. The first pressure element and the second pressure element are shaped to apply an external force to at least two portions of the human body proximate to where a psoas muscle, an Iliacus muscle, and a rectus femorus muscle intersect.

10 Claims, 8 Drawing Sheets

(52) U.S. Cl.
CPC .. *A61H 2201/165* (2013.01); *A61H 2201/169* (2013.01); *A61H 2201/1623* (2013.01); *A61H 2201/1628* (2013.01); *A61H 2201/1645* (2013.01); *A61H 2205/08* (2013.01); *A61H 2205/081* (2013.01); *A61H 2205/088* (2013.01); *A61H 2205/108* (2013.01)

(56) References Cited

U.S. PATENT DOCUMENTS 4,716,898 A * 1/1988 Chauve ..... A61H 39/04 601/134
5,445,647 A * 8/1995 Choy ..... A61H 39/04 128/101.1
5,512,056 A * 4/1996 Stevens ..... A61B 17/1325 606/203
5,569,169 A * 10/1996 Lewark, Sr. ..... A61H 7/001 601/134
5,695,520 A * 12/1997 Bruckner ..... A61B 17/1325 606/201
5,779,652 A * 7/1998 Mencher-Aliazzo ..... A61H 7/001 601/128
5,868,689 A * 2/1999 Faroky ..... A61H 15/0092 601/120
6,645,128 B1 * 11/2003 Hur ..... A63B 21/0004 482/105
6,702,771 B1 3/2004 Reinecke et al.
6,711,750 B1 * 3/2004 Yoo ..... A61F 7/02 2/338
6,746,413 B2 6/2004 Reinecke et al.
6,773,449 B2 * 8/2004 Wexler ..... A61F 5/30 606/204.15
8,109,963 B1 * 2/2012 Korrol ..... A61H 39/04 606/204
9,962,284 B2 * 5/2018 Robinson ..... A61F 7/02
2003/0120189 A1 * 6/2003 Chinea ..... A61H 15/0092 601/137
2006/0142675 A1 * 6/2006 Sargent ..... A61H 39/04 601/70
2007/0129656 A1 * 6/2007 Brooks ..... A61H 7/003 601/135
2007/0299368 A1 * 12/2007 McCarthy ..... A61H 1/0292 601/1
2008/0200853 A1 * 8/2008 Tielve ..... A61H 1/0292 601/134
2009/0326427 A1 * 12/2009 Kawahara ..... A61F 5/024 602/19
2010/0016768 A1 * 1/2010 Liu ..... A61H 23/0254 601/46
2011/0071446 A1 * 3/2011 Citrin ..... A61H 15/00 601/135
2013/0085426 A1 * 4/2013 Brodsky ..... A61H 15/00 601/128
2014/0128788 A1 * 5/2014 Marshall ..... A61F 5/024 602/19
2015/0011921 A1 * 1/2015 Sidhu ..... A61H 7/001 601/134
2015/0025568 A1 * 1/2015 Liu ..... A61H 39/04 606/204
2015/0032038 A1 * 1/2015 Atry ..... A61H 7/001 601/84
2015/0112380 A1 * 4/2015 Heller ..... A61H 7/001 606/201
2015/0320637 A1 * 11/2015 Henre ..... A61H 15/00 601/132
2016/0235625 A1 * 8/2016 Lee ..... A61H 39/04
2017/0156966 A1 * 6/2017 Chung ..... A61H 7/001
2017/0360643 A1 * 12/2017 Korrol ..... A61H 1/008

* cited by examiner

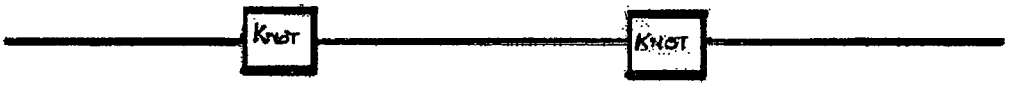
Figure
8

CANTING MECHANISM FOR AMBULATORY SUPPORT APPARATUS AND METHOD

TECHNICAL FIELD

Various embodiments described herein relate to a canting mechanism for ambulatory support apparatus and method.

BACKGROUND

Back pain (e.g., low back pain (LBP) lasting approximately 12 weeks) affects approximately tens of millions of people in the U.S. and is the second leading cause of disability (6.8 million people). Back pain is associated with reduced activities of daily living (e.g., walking, housework, personal care) and health-related quality of life. In addition, back pain is expensive to treat and often leads to missed work days (149 million days/year) and reduced productivity, resulting in total costs of $100-200 billion/year in the U.S.

Present methods to relieve back pain are ineffective, expensive, inconvenient, and/or invasive. For example, oral medications (e.g., acetaminophen, NSAIDs, muscle relaxants, tricyclic antidepressants, antiepileptics, and corticosteroids) provide only limited and/or short-lived pain relief, and typically produce side effects (e.g., sedation, dizziness, and gastrointestinal problems). Although opioids can provide substantial short-term pain relief, they are not recommended as a treatment to control chronic back pain, since long-term use can result in dependence and severe side effects.

Exercise (including yoga, stretching, strength training) has a low level of risk and can relieve pain and improve function long-term, but patients often fail to comply with treatment regimens due to discomfort, lack of motivation, and inconvenience.

Physical manipulation (i.e., massage, spinal manipulation) has a low level of risk and can provide short-term pain relief. However, evidence for the long-term benefit of physical manipulation has been mixed. Further, frequent treatment sessions are required to maintain pain relief, which is inconvenient for patients.

Acupuncture is minimally-invasive, and studies have suggested that acupuncture can provide pain relief. However, study design in acupuncture studies has been questionable (e.g., adequacy of sham/placebo/control), and the effectiveness of acupuncture remains controversial.

Injections of steroids or anesthetic provide short-term pain relief but seldom produce long-term benefit. As well, injections of such medicines produce side effects, including increased pain, lightheadedness, headache, infection, and sea and vomiting.

Intrathecal drug therapy can be effective for reducing pain but requires an invasive) procedure and is limited h a host of frequent side effects (e.g., nausea, infection, intrathecal granuloma). Also, technical complications (i.e., problems with catheter or pump) are common and may require reoperation or removal of the device.

Surgical procedures for back pain (e.g., spinal fusion, disc replacement) are highly invasive, irreversible, carry risks of complications, and reduce pain in less than half of patients. Also, surgeries for chronic back pain frequently require reoperation.

Existing methods of electrical stimulation reduce pain by generating paresthesias (i.e., tingling sensation) overlapping the regions of pain. Pain relief using these existing methods persists only for a short time following treatment (e.g., hours to days), and this suggests that chronic pain has not been reversed. As a result, only a small percentage of patients using existing methods of electrical stimulation experienced clinically significant reductions in chronic axial low back pain post-treatment.

TENS is a non-invasive method to deliver electrical stimulation through surface electrodes to generate paresthesia coverage of the regions of pain. TENS requires frequent treatment sessions to maintain pain relief, but consistent efficacy in chronic low back pain has not been demonstrated. Although TENS can be self-administered at home, TENS systems are cumbersome and not practical for daily use. Also, TENS can activate cutaneous fibers and cause irritation and discomfort, limiting the maximum tolerable stimulation intensity and treatment duration that can be delivered and reducing the potential efficacy of the treatment.

Spinal cord stimulation is a method to deliver electrical stimulation through implanted leads connected to an implanted pulse generator to generate paresthesia coverage of the regions of pain. Spinal cord stimulation requires complex and invasive surgery to implant the leads and pulse generator. Spinal cord stimulation has a moderate rate of complications, including additional pain and hardware complications, and as a result, revision surgery, reprogramming, or removal of the stimulator is often required.

In summary, present treatments for back pain seldom provide adequate long-term relief of pain or improvements in function; carry risks of side effects and complications; and/or are invasive.

There remains room in the art of pain management for unproved system and methods to be used to assist in the treatment of back pain.

SUMMARY

An apparatus for placing pressure on a plurality of trigger points includes a support, a first pressure element, and a second pressure element. The first pressure element is carried by the support. The second pressure element is also carried by the support. The first pressure element is moveable with respect to the support. The second pressure element is also moveable with respect to the support. The first pressure element and the second pressure element are shaped to apply a force to at an external point on a human body proximate to where a psoas muscle, an Iliacus muscle, and a rectus femorus muscle intersect. There are at least two points on the human body where the psoas muscle, the Iliacus muscle, and the rectus femorus muscle intersect. These at least two points are on the lower portion of a trunk of a human. The support can be made of any number of materials.

The apparatus for placing pressure on a plurality of trigger points can further include a back paddle carried by the support. The back paddle includes a third pressure element and a fourth pressure element. These elements are generally spaced from one another. The spacing allows the third pressure element and the fourth pressure element to straddle or extend to both sides of a person's spinal column and rest on or place a force on muscles at or near the back of the human trunk.

A method for placing pressure on a plurality of trigger points includes providing a support having a first pressure element carried by the support, and a second pressure element carried by the support, and attaching the support so that the pressure elements are positioned over trigger points near the waist of the human being. The support also includes a back paddle having elements that are placed on the human so that these elements straddle the spinal column and place pressure on muscles near the spinal column.

BRIEF DESCRIPTION OF THE DRAWINGS

The invention is pointed out with particularity in the appended claims. However, a more complete understanding of the present invention may be derived by referring to the detailed description when considered in connection with the figures, wherein like reference numbers refer to similar items throughout the figures and:

FIG. 8 is a view of a mechanism for placing pressure on a set of trigger points that include the intersection of the psoas, liliaca and rectus femorus, in which the pressure element is a knot, according to another example embodiment.

The description set out herein illustrates the various embodiments of the invention and such description is not intended to be construed as limiting in any manner.

DETAILED DESCRIPTION

Figure 1A:
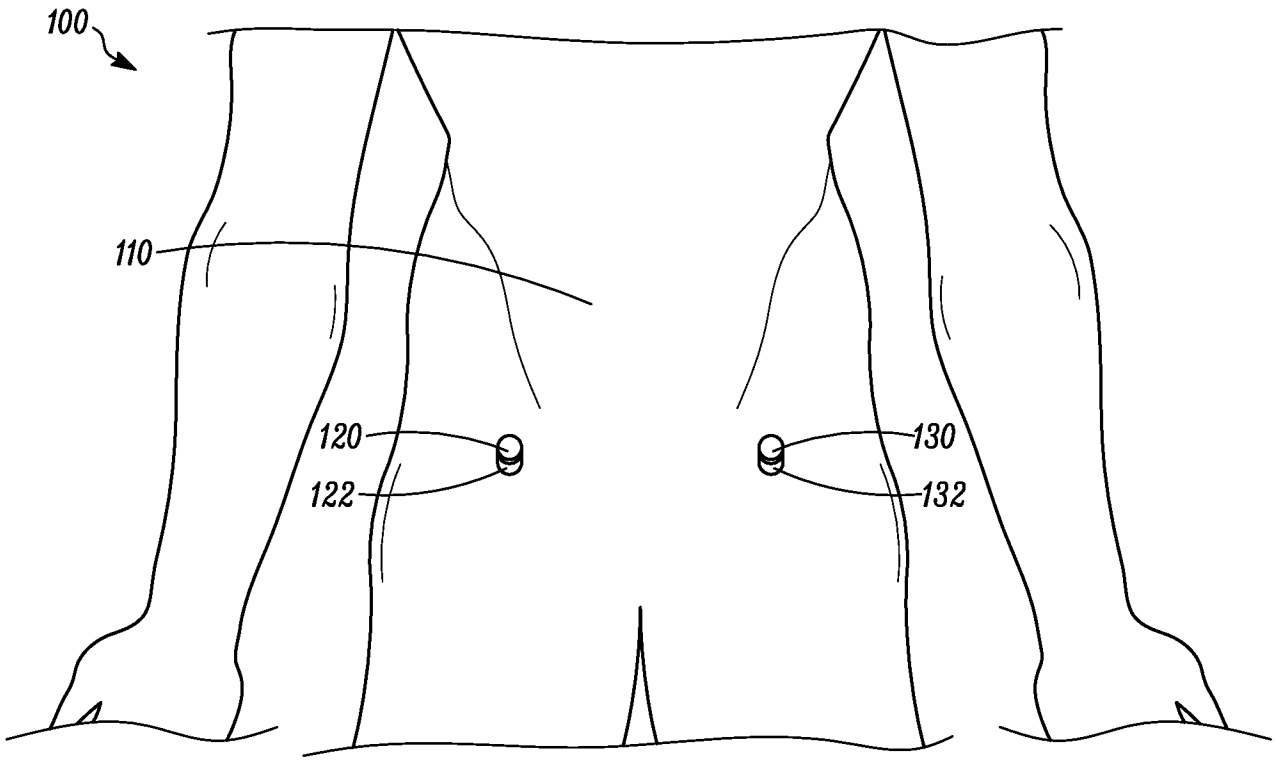
FIG. 1A is a view of human body exterior and includes a set of trigger points on the body.

FIG. 1A is a front view of a portion of a human body 100 and shows several muscles associated with the trunk 110 of the human body 100. Specifically, FIG. 1 is a view of the exterior portion of the front of the trunk that includes the point where the psoas, Iliacus, and rectus femorus muscles intersect and connect. There are two points 120 and 130 on the body where this happens. The point 120 is on the left front portion of the truck 110. The point 130 is on the right front portion of the trunk 110. The points 120 and 130 are proximate points within the body 100 where there is an intersection or connection point of the above-mentioned muscles. These connection points are also common trigger points 122, 132. The trigger points are within the human body 100 but can be accessed or treated from the exterior of the body 100. At times muscles knot at the trigger points. The trigger points can be thought of as small patches of clenched muscle fibers that are sensitive and cause aching and stiffness. A trigger point may be a major factor in many common pain problems like low back pain and neck pain. Many times, trigger points may generate symptoms that are removed or remote from the location of the trigger point.

Figure 1B:
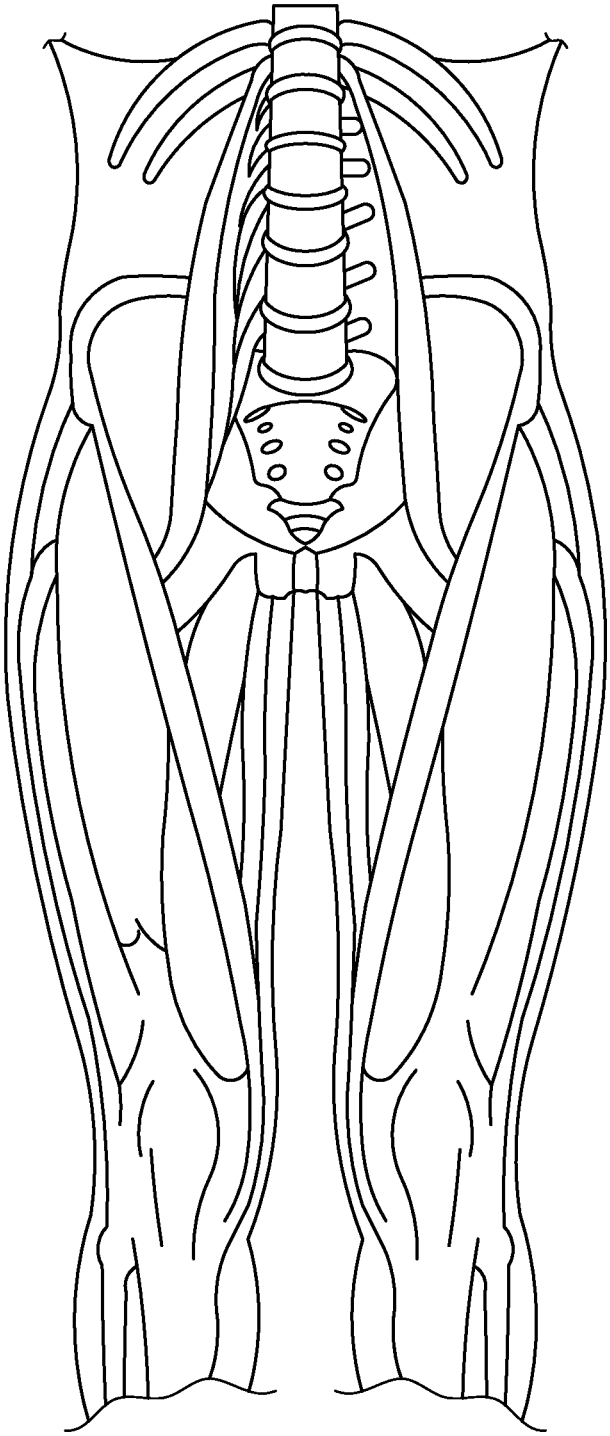
FIG. 1B is a view of human body musculature and includes a set of trigger points on the body.

FIG. 1B is a view of the musculature of the human body and includes a set of trigger points on the body. As shown in FIG. 1B, the trigger points 122 and 132 are shown. Also shown are the psoas muscle 140, 141, the Iliacus muscle 142, 143, and rectus femorus muscle 144, 145. The trigger point 122 occurs at the intersection of the psoas muscle 140, the Iliacus muscle 142, and rectus femorus muscle 144. The trigger point 132 occurs at the intersection of the psoas muscle 141, the Iliacus muscle 143, and rectus femorus muscle 145. The trigger points 122, 132 are treatable from the points 120, 130 on the exterior portion of the trunk of the human body 100.

One factor in back and hip pain is frequently the psoas muscle. Many believe the psoas muscle is one of the most important muscles in the body. A number of problems may be related to the psoas muscle. The problems include low back pain, sacroiliac pain, sciatica, disc problems, spondylolysis, scoliosis, hip degeneration, knee pain, menstruation pain, infertility, and digestive problems. The list can also include biomechanical problems like pelvic tilt, leg length discrepancies, kyphosis, and lumbar lordosis.

The psoas primarily flexes the hip and the spinal column. At about 16 inches long on the average, it is one of the largest and thickest muscles of the body (in animals it is known as the tenderloin). This powerful muscle runs down the lower mid spine beginning at the 12th thoracic vertebrae connecting to all the vertebral bodies, discs and transverse processes of all the lumbar vertebrae down across the pelvis to attach on the inside of the top of the leg at the lesser trochanter. The lower portion combines with fibers from the iliacus muscle, which sits inside the surface of the pelvis and sacrum, to become the Iliopsoas muscle as it curves over the pubic bone and inserts on the lesser trochanter.

The psoas has a number of diverse functions, making it a key factor in health. The psoas functions as a hip and thigh flexor, which makes it the major walking muscle. If the legs are stationary the action of it is to bend the spine forward; if sitting, it stabilizes and balances the trunk. The lower psoas brings the lumbar vertebrae forward and downward to create pelvic tilt.

When the psoas muscle becomes contracted due to injuries, poor posture, prolonged sitting, or stress, it can alter the biomechanics of the pelvis and the lumbar, thoracic and even cervical vertebrae. Typically a dysfunctional psoas is responsible for referred pain down the front of the thigh and vertically along the lower to mid spinal column. Trigger points are found above the path of the psoas on the abdomen. Frequently the quadratus lumborum muscles develop trigger points, as well as the piriformis, gluteals, hamstrings, and erector spinae psoas.

The psoas can torque your spine to the right or left, pull it forward and twist the pelvis into various distortions. Frequently one psoas will shorten and pull the spine and/or pelvis to our dominant side. The distortions of the spine and pelvis can also show up as a short or long leg. This all results in scoliosis, kyphosis, lordosis, trigger points, and spasms in back muscles trying to resist the pulling of the psoas.

It can also pull the spine downward, compressing the facet joints and the intervertebral discs of the lumbar spine. The pressure can cause the discs to degenerate, becoming thinner and less flexible. This degeneration makes the discs more susceptible to bulging or tearing, especially with twisting and bending movements.

The psoas will stay contracted because of postural habits and trauma. The way we stand, walk and sit can distort the psoas. If we walk or stand with our chin in an overly forward position the muscle will tighten. Sitting through much of the day causes the muscle to shorten to keep us bio-mechanically balanced in our Chairs. Over time we develop a "normal" way of holding the psoas that is dysfunctional.

Figure 2:
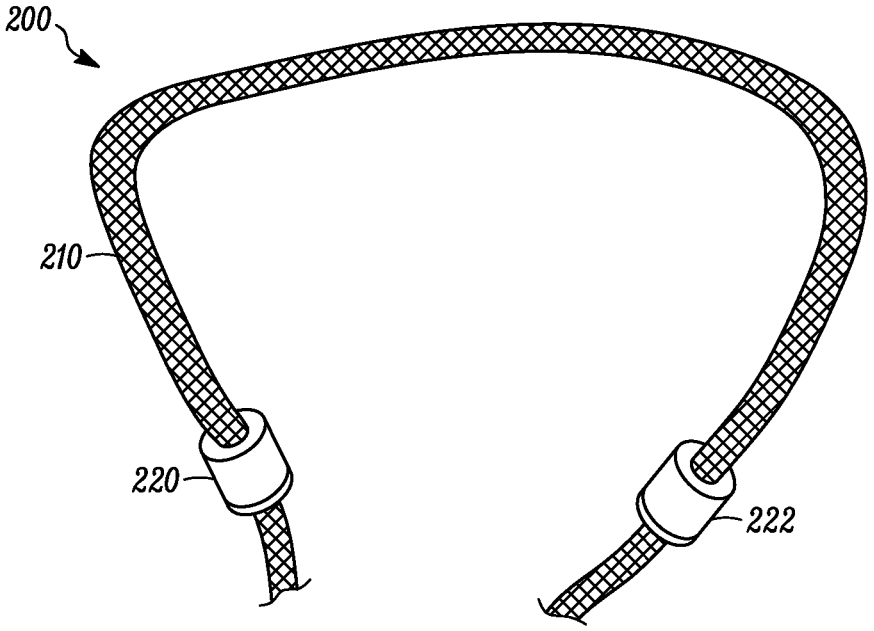
FIG. 2 is a view of a mechanism for placing pressure on a set of trigger points that include the intersection of the psoas, liliaca and rectus femorus, according to an example embodiment.

FIG. 2 is a view of a mechanism for placing pressure on a set of trigger points that include the intersection of the psoas, liliaca and rectus femorus, according to an example embodiment. The mechanism or apparatus 200 places pressure on a set of trigger points 122, 132 (shown in FIGS. 1A and 1B) of the body 100, according to an example embodiment. The mechanism or apparatus 200 includes a support or a support belt 210. The support belt 210 can be elastomeric or less than elastomeric. The support belt can be made of substantially non-stretch nylon, cording or the like. The support belt 210 could also be made of cloth. The support belt can be a thin cord or a wide belt. Common to all types of support belts 210 is that the support belt 210 carries a first pressure element 220 and a second pressure element 222. The first pressure element 220 and the second pressure element 222 are moveable with respect to the support belt 210. The pressure elements are also moveable with respect to one another. The pressure element can be of any shape. The pressure elements 220, 222 can be balls, cylinders, pyramidal or the like. In this way, the first pressure element 220 can be positioned over the left trigger point 122 on the human body (see FIG. 1) and the second pressure element 220 can be positioned over the right trigger point 132 (see FIG. 1). The length of the support belt 210 can be adjusted to place more or less pressure on the left trigger point 122 and the right trigger point 132. For example, the support belt can be tied with a shortened length to place more force on the first pressure element 220 and the second pressure element 222. Some example of the support belt 210 can include a buckle and a free end with openings therein for engaging the buckle. Other support belts 210 can merely be tied. Other mechanisms can be used to attach the support belt to the lower trunk portion of a human body 100. It should also be noted that the ends for tying or buckling can occur on one side of the body or the other. Of course, it would be inconvenient to make the tie points or buckling portions over the pressure points. It should also be noted, that the support belt can be one portion or a plurality of portions connected or otherwise attached to one another. As mentioned above, the first pressure element 220 and the second pressure element 222 are movable with respect to the support belt 210 so that the mechanism or apparatus 200 can be adjusted from one individual to another. The first pressure element 220 and the second pressure element 222 are placed over the trigger points 122, 132. It should be noted that the distance between these trigger points differs with each individual. Of course, the spacing between the first pressure element 220 and the second pressure element 222 can be the same for some individuals.

The first pressure element 220 and the second pressure element 222 can be made of a material that places pressure on the trigger points 122, 132. The first pressure element 220 and the second pressure element 222 can be made of plastic or rubber. In general, the rubber will have a relatively high durometer rating so that it will place a force on the trigger points 122, 132. The amount of pressure is related to the amount of force placed on the support belt. With the support belt 210 shown in FIG. 2, the force will be distributed over a portion of the back and to the pressure elements 220, 222. The pressure associated with the pressure elements 220, 222 is related to the area that is in contact with the body 100. The area for each pressure elements can be determined in square inches. The force applied divided by the area of the pressure element yields the actual pressure applied to the body 100 by the pressure elements 220, 222.

FIG. 8 is a view of a mechanism for placing pressure on a set of trigger points that include the intersection of the psoas, liliaca and rectus femoris, in which the pressure element is a knot, according to another example embodiment. As shown in FIG. 8, the pressure elements are knots made in the support. Of course, the support in this embodiment is made of cording or the like as described above.

Figure 3:
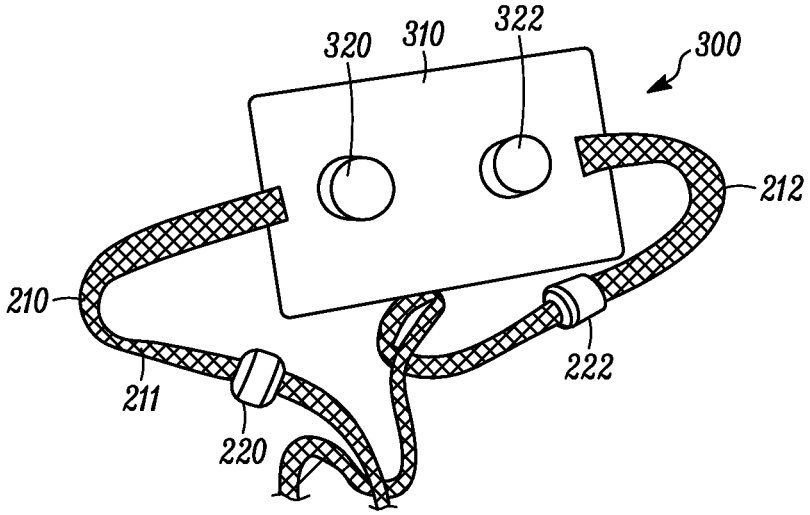
FIG. 3 is another view of a mechanism for placing pressure on a set of trigger points, according to an example embodiment.

FIG. 3 is another view of a mechanism or apparatus 300 for placing pressure on a set of trigger points, according to an example embodiment. This particular embodiment differs from the apparatus 200 in that the apparatus 300 for placing pressure on a plurality of trigger points 122, 132 further includes a back paddle 310 carried by the support 210. The back paddle includes a third pressure element 320 and a fourth pressure element 322. These elements 320, 322 are generally spaced from one another. In one embodiment, the third pressure element 320 and the fourth pressure element 322 are spaced so that they can straddle or extend to both sides of a person's spinal column and rest on or place a force on muscles at or near the back of the human trunk 110. As shown, the third pressure element 320 and the fourth pressure element 322 are fixed with respect to the back paddle 310. In other example embodiments, the third pressure element 320 and the fourth pressure element 322 may be adjustable with respect to the back paddle 310. As a result, the distance between the third pressure element 320 and the fourth pressure element 322 could be varied for each individual. The third pressure element 320 and the fourth pressure element 322 specifically place pressure on the sacral tubercle ligaments and gluteus medias attachments. The constant, gentle pressure of the third pressure element 320 and the fourth pressure element 322 allows the tissue at or near the sacral tubercle ligaments and gluteus medias attachments to gently release and stay released. The more it tightens, the more gentle pressure is created. The result is an ebb and flow of tissue release as the brain acclimates.

It should be noted that in this particular embodiment, the support 210 is actually formed of a first support portion 211 and a second support portion 212. The first support portion 211 is attached to one end of the back paddle 310 and the second support portion 212 is attached to the other end of the back paddle 310. The first support portion 211 and the second support portion 212 include free ends which can be connected to each other to vary the force and ultimately the pressure applied by the first pressure element 220, the second pressure element 222, the third pressure element 320 and the fourth pressure element 322. Again, the pressure elements can be made of various materials and made of various shapes with various areas to place appropriate amounts of pressure to the exterior portions of the human body.

In operation, the apparatus 300 is an ambulatory support device includes two support portions 211, 212 or straps with adjustable balls or elements 220, 222 to be positioned on the front of the user's body. The two support portions 211, 212 or straps connect to the canting mechanism of the human body 100 and allows direct, constant pressure on the sacrum within the body. The apparatus 300 allows the user to rotate about associated pivots, such as pressure points 122, 132 to allow the support paddle 310 to conform to the user's body and synchronizes the anterior pressure mechanisms on both left and right substantially simultaneously of the support belt 210 such that any anterior engagement subsides and posterior engagement dominates, respectively, of a substantially equivalent or greater magnitude. The traction of the device provides stability to the user's body 100.

The apparatus for placing pressure on a plurality of trigger points can further include a back paddle carried by the support. The back paddle includes a third pressure element and a fourth pressure element. These elements are generally spaced from one another. In one embodiment, the third pressure element and the fourth pressure element are spaced so that they can straddle or extend to both sides of a person's spinal column and rest on or place a force on muscles at or near the back of the human trunk.

An apparatus for placing pressure on a plurality of trigger points includes a support, a first pressure element, and a second pressure element. The first pressure element is carried by the support. The second pressure element is carried by the support. The first pressure element is moveable with respect to the support, and the second pressure element is moveable with respect to the support. The first pressure element and the second pressure element are also moveable with respect to each other. The support has a length so that the support can be attached around a lower portion of the trunk of a human body. The first pressure element and the second pressure element are shaped to apply an external force to at least two portions of the human body proximate to where a psoas muscle, an Iliacus muscle, and a rectus femorus muscle intersect. In one embodiment, the apparatus also includes a back paddle movably engaged with the support, a third pressure element and a fourth pressure element attached to the back paddle. The third pressure element is spaced from the fourth pressure element so that the third pressure element is placable on one side of a human spine and the fourth pressure element is placable on the other side of the human spine.

Figure 4:
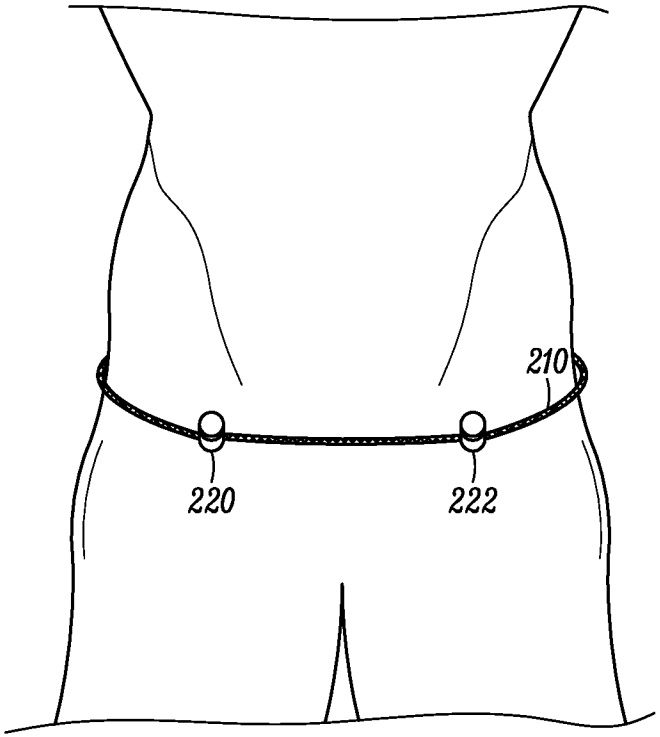
FIG. 4 is a front view of a human body with a mechanism for placing pressure on a set of trigger points attached to the body, according to an example embodiment.

FIG. 4 is a front view of a human body 100 with a mechanism 200, 300 for placing pressure on a set of trigger points attached to the body, according to an example embodiment. The strap or belt or support 210 fits around the waist/at the point where the psoas, Iliacus, and rectus femorus, intersect or attach to one another or at a common point. The intersection point is a pressure point 122, 132 (shown in FIGS. 1A and 1B). Stated more accurately, the pressure elements 220, 222 are positioned over these points on the exterior of the body. The device 200, 300 can be fitted over a person's clothes and still positively effect the posture of the user by effecting the canting mechanism of the body. One use is in an office environment where workers sit for long periods of the work day. By using the mechanism 200, 300, the muscles the pressure elements 220, 222 relax the muscles at the pressure points 122, 132 to all them to pivot and place the user in a position of better posture.

Figure 5:
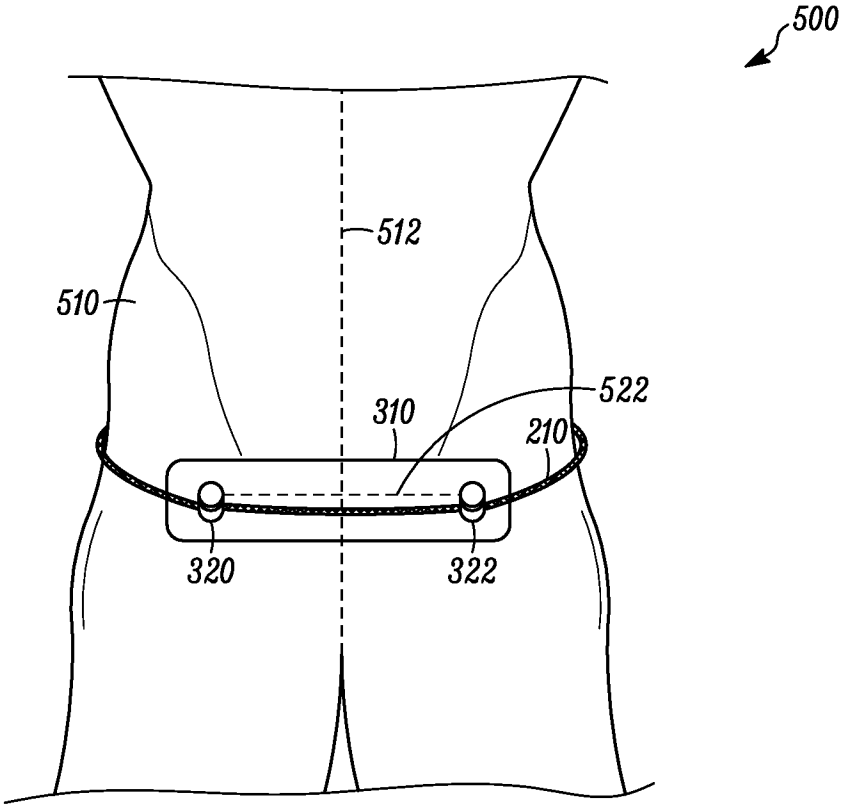
FIG. 5 is a back view of a human body with a mechanism for placing pressure on a set of trigger points attached to the body, according to an example embodiment.

FIG. 5 is a rear view of a human body with a mechanism 300 for placing pressure on a set of trigger points attached to the body, according to an example embodiment. The rear view shows a human back side 510. The back paddle 310 carried by the belt or support 210. The back paddle 310 includes a third pressure element 320 (shown in phantom) and a fourth pressure element 322 (shown in phantom). The elements 320, 322 are shown in phantom in this view since they would be covered by the back paddle 310 when it is attached or strapped to the user. The back side 510 includes a dotted line 512 representative of the human spine. These elements 320, 322 are generally spaced from one another so that they can straddle or extend to both sides of a person's spine 512 or spinal column. The pressure elements 320, 322 rest on or place a force on muscles on a person's back 510 at or near the spine 512 or spinal column. Shown in FIG. 5 is a dotted line 522 defined by elements 320, 322. The line 522 is imaginary. The line 522 traverses line 512. Put another way, line 522 traverses the spinal cord, represented by line 512.

Figure 6:
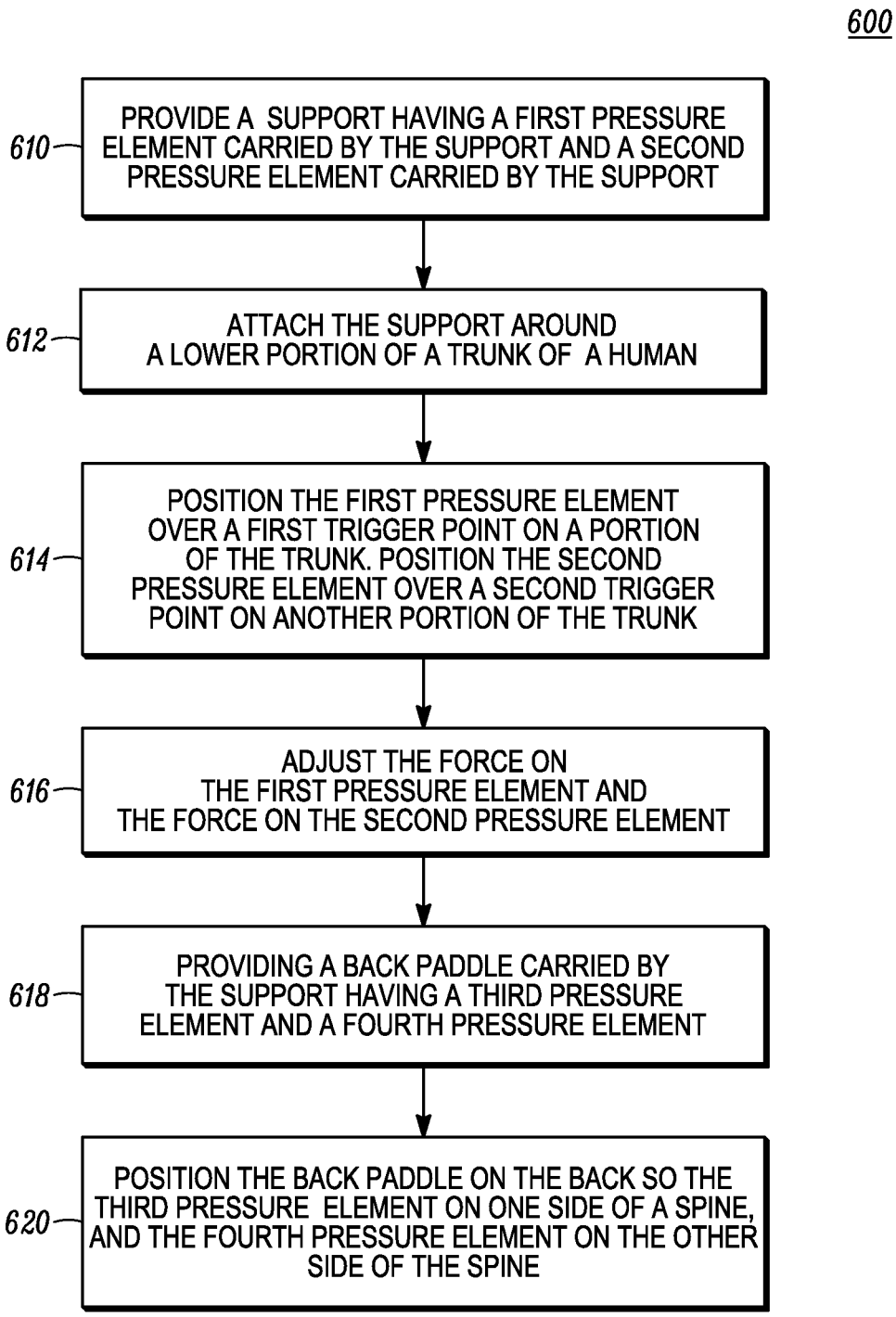
FIG. 6 is a flow diagram of a method for placing of a mechanism for placing pressure on a set of trigger points onto the trunk of a body, according to another example embodiment.

FIG. 6 is a flow diagram of a method 600 for placing of a mechanism for placing pressure on a set of trigger points onto the trunk of a body, according to another example embodiment. The method 600 for placing pressure on a plurality of trigger points includes providing a support 610 having a first pressure element carried by the support, and a second pressure element carried by the support. The method 600 also includes attaching the support around a lower portion of a trunk of a human 612. The first pressure element, moveable with respect to the support, is positioned over a first trigger point on a portion of the trunk. The second pressure element, moveable with respect to the support, is positioned over a second trigger point on another portion of the trunk 614. The support is adjusted to adjust the force on the first pressure element and the force on the second pressure element 616. The first pressure element is positioned over a lower front external portion of the trunk of the human body proximate one of at least two areas where a psoas muscle, an Iliacus muscle, and a rectus femorus muscle intersect. The second pressure element is positioned on a lower front external portion of the trunk at another area where a psoas muscle, an Iliacus muscle, and a rectus femorus muscle intersect. The support can be elastomeric support or the like. Adjusting the support to adjust the force on the first pressure element and the force on the second pressure element 616 includes tightening the support. The method 600 also includes providing a back paddle 618 carried by the support. The back paddle includes a third pressure element and a fourth pressure element. The back paddle is positioned on the back so the third pressure element on one side of a spine, and the fourth pressure element on the other side of the spine 620. The third pressure element and fourth pressure element can be positioned so that a line between the third pressure element and the fourth pressure element traverses the spine or a plane that includes the spine. The third pressure element is positioned on a third pressure point, and the fourth pressure element is positioned on a fourth pressure point. The support or belt can be tightened or loosened to adjust the amount of force placed by the support on the first pressure element, second pressure element, third pressure element and the fourth pressure element.

Figure 7:
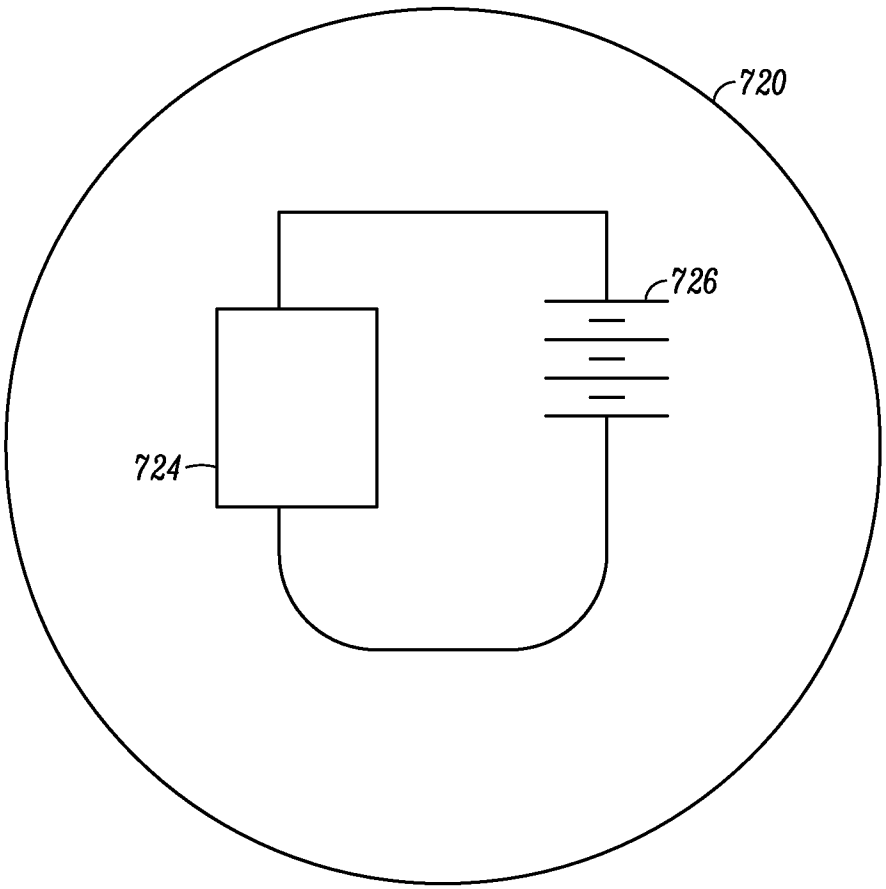
FIG. 7 is a schematic representation of a pressure element further comprising a vibration element, according to an example embodiment.

FIG. 7 shows a schematic representation of a pressure element 720, according to another example embodiment. The pressure element 720 can be substituted for any of the other pressure elements 220, 222, 320, 322 of the mechanisms 200, 300 discussed above. The pressure element 720 includes an element 724 that produces vibration within the pressure element 720. The vibration element 724, in one embodiment, is powered by a battery 726. In another embodiment, the vibration element could be electrically connected to an external power source, such as a larger battery or an AC current source. It is contemplated that the vibration element 724 could be connected to most any current source.

The foregoing description of the specific embodiments reveals the general nature of the invention sufficiently that others can, by applying current knowledge, readily modify and/or adapt for various applications without departing from the concept, and therefore such adaptations and modifications are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

The invention claimed is:

1. An apparatus for placing pressure on a plurality of trigger points, the apparatus comprising:

a support comprising a corded material attachable around a lower portion of a human body;

a first pressure element;

a second pressure element wherein the first pressure element and the second pressure element are each moveable along the support, and moveable with respect to each other and are configured to apply an external force to at least two trigger points on the human body where a psoas muscle, an Iliacus muscle, and a rectus femoris muscle intersect;

a back paddle movable engaged with the support;

a third pressure element attached to the back paddle; and a fourth pressure element attached to the back paddle, the third pressure element spaced from the fourth pressure element so that the third pressure element is configured to be placed on a first side of a human spine and the fourth pressure element is configured to be placed on a second side of the human spine, wherein the second side of the spine is different from the first side of the spine, wherein the third pressure element is shaped to contact a third pressure point on the first side of the spine and the fourth pressure element is shaped to contact a fourth pressure point on the second side of the spine, wherein the third pressure point comprises an external point on the human body overlying a sacral tubercle ligament and the fourth pressure point comprises an external point on the human body overlying a gluteus medias attachment.

2. The apparatus of claim 1, wherein the first pressure element is a first pressure ball and the second pressure element is a second pressure ball, and wherein, the first pressure ball and the second pressure ball are made of substantially uncompressible material.

3. The apparatus of claim 2, wherein the first pressure ball and the second pressure ball are made of a plastic material.

4. The apparatus of claim 2, wherein the first pressure ball and the second pressure ball are made of a cork material.

5. The apparatus claim 1, wherein the first pressure element and the second pressure element are made of a cord formed as a knot.

6. The apparatus of claim 1, wherein at least one of the first pressure element and the second pressure element comprises a vibrator.

7. The apparatus of claim 1, wherein the support is elastic.

8. A method for placing pressure on a plurality of trigger points, the method comprising:

providing a support comprising a corded material, a first pressure element moveable on the support, and a second pressure element moveable on the support;

attaching the support around a lower portion of a trunk of a human body;

positioning the first pressure element over a first trigger point on a portion of the trunk, such that the first pressure element contacts a first external point on a first area of the human body where a psoas muscle, an Iliacus muscle, and a rectus femoris muscle intersect;

positioning the second pressure element on the support over a second trigger point on another portion of the trunk such that the second pressure element contacts a second external point on a second area of the human body where a psoas muscle, an Iliacus muscle, and a rectus femoris muscle intersect;

applying a back paddle on the support, the back paddle comprising a third pressure element and a fourth pressure element, adjusting the third pressure element and the fourth pressure element on the back paddle to apply pressure on muscles at a rear of the human trunk, wherein the third pressure element is shaped to contact a third pressure point on a first side of a spine and the fourth pressure element is shaped to contact a fourth pressure point on a second side of the spine different from the first side of the spine, and wherein the third pressure point comprises an external point on the human body overlying a sacral tubercle ligament and the fourth pressure point comprises an external point on the human body overlying a gluteus medias attachment; and adjusting the support to adjust a force on the first pressure element, and the force on the second pressure element, the force on the third pressure element, and the force on the fourth pressure element.

9. The method of claim 8, wherein the support is elastic.

10. The method of claim 8, wherein adjusting the support to adjust the force on the first pressure element and the force on the second pressure element includes tightening the support.

* * * * *